United States Patent [19]

Bergdahl

[11] 4,219,307

[45] Aug. 26, 1980

[54] ARRANGEMENT IN AXIAL FANS, COMPRESSORS, TURBINES, PUMPS OR THE LIKE

[76] Inventor: Knut Bergdahl, Kvartsgränd 4, S-852 52 Sundsvall, Sweden

[21] Appl. No.: 927,509

[22] Filed: Jul. 24, 1978

[30] Foreign Application Priority Data

Aug. 2, 1977 [SE] Sweden ..... 7708818
Jan. 3, 1978 [SE] Sweden ..... 7800049

[51] Int. Cl.[2] ..... F04D 1/04

[52] U.S. Cl. ..... 415/182; 415/219 R; 415/204

[58] Field of Search ..... 415/52, 53 R, 55, 182, 415/185, 203, 204, 205, 207, 213 C, 216, 217, 219 R

[56] References Cited

U.S. PATENT DOCUMENTS

| | | | |
|---|---|---|---|
| 44,715 | 10/1864 | Farmer | 415/205 |
| 184,952 | 12/1876 | Boulton et al. | 415/203 |
| 263,010 | 8/1882 | Barrett | 415/203 X |
| 1,817,169 | 8/1931 | Schwitzer et al. | 415/217 |
| 1,920,484 | 8/1933 | Siemen et al. | 415/182 |
| 4,102,597 | 7/1978 | Itayama | 415/217 X |

FOREIGN PATENT DOCUMENTS 2524556 12/1975 Fed. Rep. of Germany ..... 415/219 R

*Primary Examiner*—Leonard E. Smith
*Attorney, Agent, or Firm*—Charles E. Brown

[57] ABSTRACT

This invention is related to an arrangement in fans, compressors, turbines, pumps or the like, comprising at least one wheel, which is provided with vanes and through which a fluid is intended to pass at least partially in an essentially axial direction, and at least one inlet and one outlet opening. The main object of the invention is to improve this arrangement so that higher pressures may be obtained when used for driving a fluid and so that a better energy absorption from a fluid may be obtained when the fluid is driving the wheel. This object is achieved in that said wheel is arranged in a housing formed by a mantle provided at least partially about the periphery of the wheel and at least two side walls provided on opposite sides of the wheel, said housing and/or one or more parts associated therewith extending to the vicinity of the wheel on at least one side thereof.

13 Claims, 14 Drawing Figures

ARRANGEMENT IN AXIAL FANS, COMPRESSORS, TURBINES, PUMPS OR THE LIKE

This invention is related to an arrangement in fans, compressors, turbines, pumps or the like, comprising at least one wheel, which is provided with vanes and through which the fluid is intended to pass at least partially in an essentially axial direction, and at least one inlet and one outlet opening.

Wheels having vanes and being intended for essentially axial passage of a fluid (normally termed axial wheels) are common in fans, compressors, turbines and pumps. A severe disadvantage associated to wheels of this kind is their limited ability to create pressure, especially when light fluids such as gases are concerned. When wheels of this kind are used in connection with turbines or the like, the ability of the wheels to absorb energy from a flowing fluid is limited, again particularly when light fluids such as gases are concerned. Expressed in other words, the known wheels are associated to disadvantages regardless if they are driven or driving.

The object of the invention is to provide an arrangement of the kind indicated, by means of which pressure improvements may be obtained when the wheel is driven and by means of which the energy absorption of the wheel may be improved when a fluid driving the wheel is used.

This object is achieved according to the invention, the improvement of which comprising said wheel being arranged in a housing formed by a mantle provided at least partially about the periphery of the wheel and at least two sidewalls provided on opposite sides of the wheel, said housing and/or one or more parts associated therewith extending to the vicinity of the wheel on at least one side thereof. With this solution, it is possible to obtain an increased pressure in the fluid downstream the wheel when the arrangement is used as a fan, compressor, pump or the like due to the fact that the fluid by the housing at least partially is imparted a helicoidal axial motion through the wheel and the housing.

When the arrangement is used as a turbine or the like, an increased ability of energy absorption is obtained in a similar manner.

With reference to the appended drawings, below follows a more specific description of embodiments of the invention.

Figure 1:
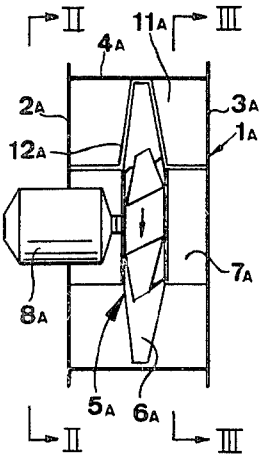
FIG. 1 is a section through an arrangement according to the invention comprising an axial flow wheel.
Figure 2:
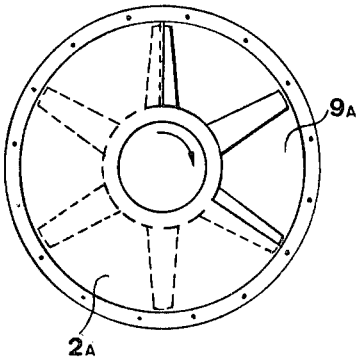
FIG. 2 is a view along the line II—II in the FIG. 1.
Figure 3:
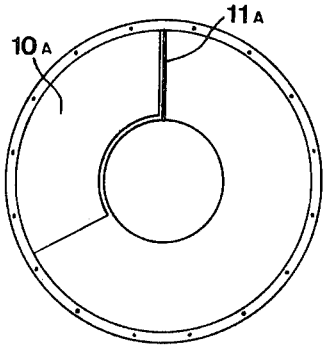
FIG. 3 is a section along the line III—III in FIG. 1.

In FIGS. 1–3, a housing is generally denoted 1A. The housing comprises two side walls 2A, 3A which have an essentially circular form. A circular mantle 4A extends between the side walls. Within the housing 1A, there is provided a rotatable fan wheel 5A having radially extending vanes 6A. The wheel 5A has a cylindrical hub 7A and is in a suitable manner journalled in the side walls 2A, 3A and through a shaft connected to a motor 8A which partially projects within hub 7A and protrudes out through side wall 2A. The motor 8A is suitably mounted to side wall 2A.

The side walls 2A, 3A extend transversely and suitably perpendicularly to the axis of rotation of wheel 5A. The mantle 4A is concentrically located relative to said axis of rotation and provided near the free ends of vanes 6A. In the side wall 2A, there is provided an axially directed inlet opening 9A and in the side wall 3A there is provided an axially directed opening 10A.

A partition 11A extends from at least one of the side walls in a direction towards the wheel 5A. More specifically, the partition extends between the side walls 2A, 3A and has an opening 12A for the vanes 6A. The shape of the opening 12A corresponds to the shape of the vanes. Partition 11A extends between the hub 7A and mantle 4A. The partition 11A terminates at a short distance from hub 7A since the hub is arranged to rotate with the wheel. As is apparent from FIG. 3, partition 11A extends essentially parallel to the axis of rotation of wheel 5A. Furthermore, partition 11A extends radially relative to wheel 5A.

The inlet opening 9A and outlet opening 10A, which have a sector like shape, are angularly displaced relative to each other. As is apparent from FIGS. 2 and 3, the inlet opening 9A and outlet opening 10 A are arranged so that they do not overlap each other as viewed in the axial direction. Partition 11A is arranged between the inlet and outlet openings.

When the wheel 5A is rotated, the fluid, particularly air, will be sucked into the inlet opening 9A and passed through the wheel in a helicoidal, essentially axial motion and then pass out through the outlet opening. The side walls, the mantle and the partition makes it possible to obtain an improved ability to create pressure downstream the wheel in the fluid to be transported. The partition acts as an efficient bar between inlet and outlet.

Figure 4:
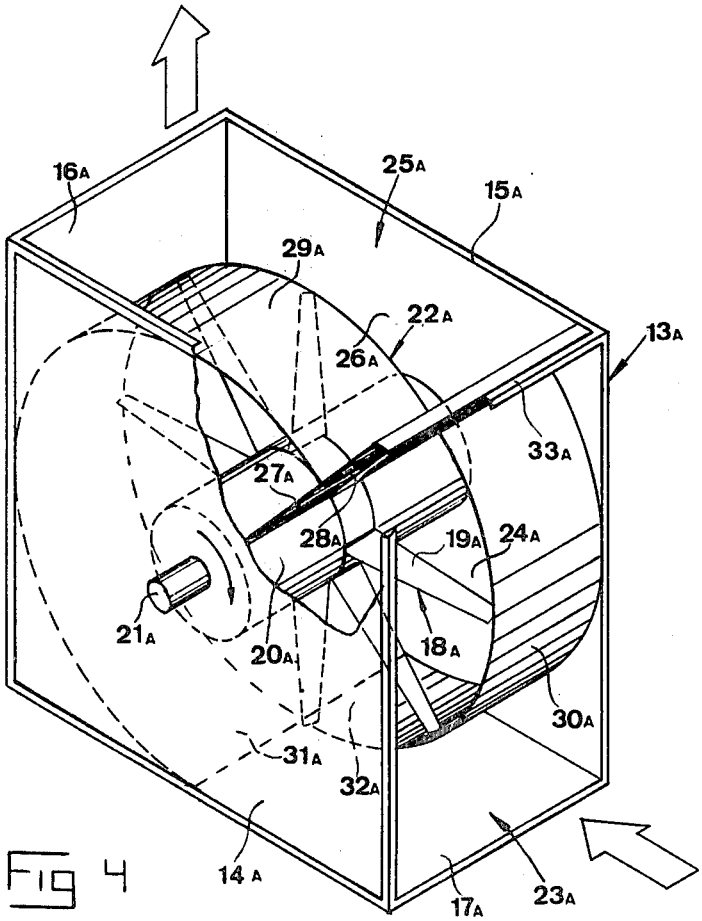
FIG. 4 is a perspective view of an arrangement according to the invention, the fluid flowing into and out of the arrangement in a radial direction.

In FIG. 4, an alternative embodiment of the invention is illustrated. This embodiment comprises a housing 13A having a vertical parallelepiped shape and comprising four walls, namely two parallel side walls 14A, 15A (corresponding to the side walls 2A, 3A in FIG. 1), a vertical wall side 16A extending between the side walls 14A, 15A at one end of the housing and a bottom 17A. The two other sides of housing 13A are open. Within housing 13A, a wheel 18A having vanes 19A is rotatably journalled. The wheel has a cylindrical hub 20A comprising a shaft 21A for connection to a motor (not shown) outside the housing. Shaft 21A is journalled in side walls 14A, 15A. The wheel 18A is surrounded by a circular mantle 22A. An inlet opening 23A is formed by one of the open side walls of the housing 13A and an opening 24A in mantle 22A. An outlet opening for the fluid to be transported is denoted 25A and formed by the other open side of the housing 13A and another opening 26A in the mantle. A partition 27A extends between side walls 14A, 15A and between hub 20A and mantle 22A. The partition 27A extends parallel to the shaft 21A and radially thereto. The partition 27A has an opening 28A for the vanes 19A.

The partition 27A extends through mantle 22A and to a reinforcing rod 33A, to which partition 27A is suitably attached. The mantle 22A is formed by two circularly curved plate pieces 29A, 30A. The extent of each plate piece in the axial direction of the wheel amounts to half the extent of the housing 13A in the same direction. The plate piece 29A is attached with one edge to side wall 14A while plate piece 30A is attached with one edge to side wall 15A. The end 31A of plate piece 29A is facing towards the inlet opening 23A and connected to the bottom 17A of housing 13A while the other end of plate piece 29A is attached to partition 27A. If necessary, the back of plate piece 29A may be connected to side wall 16A. The end 32A of plate piece 30A is attached to the bottom 17A. The other end of plate piece 30A is attached to partition 27A. Thus, the plate pieces 29A, 30A are provided side by side so that an opening 24 facing towards inlet opening 23A and an opening 26A facing towards outlet opening 25A will appear in the mantle 22A. The radial plane through wheel 18A will essentially coincide with a plane through the edges of the plate pieces 29A, 30A facing towards each other in an axial direction.

It is now evident that the embodiment according to FIG. 4 essentially corresponds to the embodiment according to FIGS. 1–3 with the exception that the inlet and outlet openings have been located in mantle 22A.

Two or more units of the kind illustrated in FIGS. 1–3 may, irrespective of use with a driven or driving wheel, be connected in series with the outlet opening of one of the units connected to the inlet opening of another unit. If required, guide blades may be mounted between the units so that the flow is directed in the direction of rotation of the wheel. This connection in series of several units may be carried out with the wheels on a common shaft.

Two or more units of the kind illustrated in FIG. 4 may be connected in parallel. In this embodiment, several wheels are preferably mounted on a common shaft having a common motor and thus, a building system may be obtained.

Figure 5:
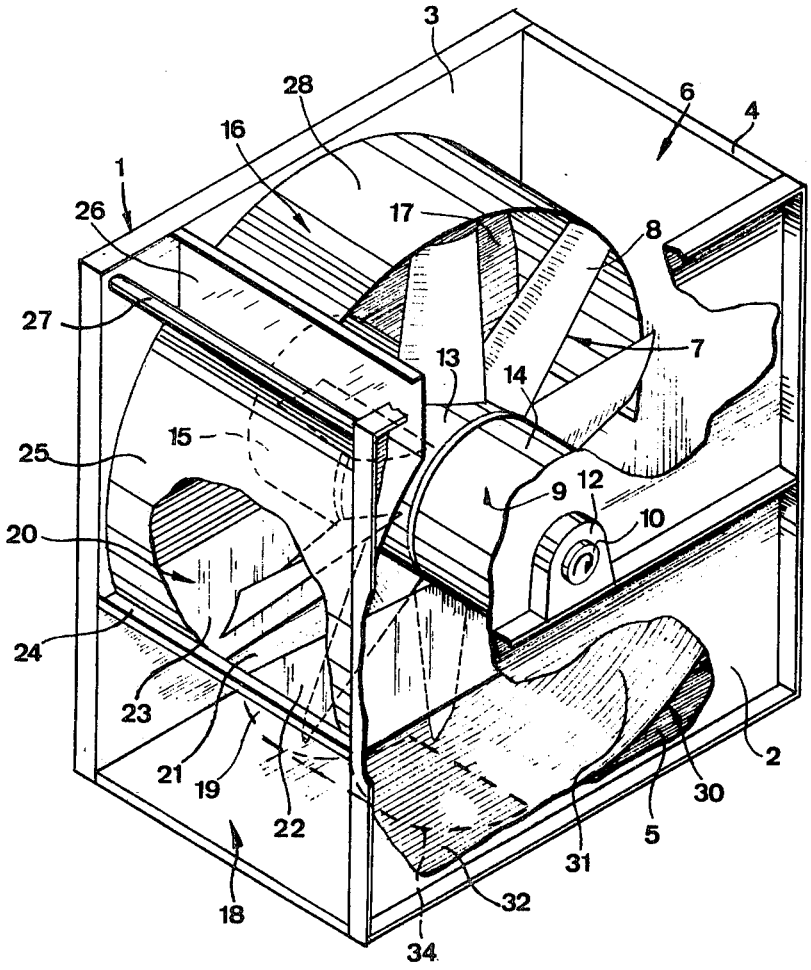
FIG. 5 is a perspective, cut view of another embodiment.
Figure 6:
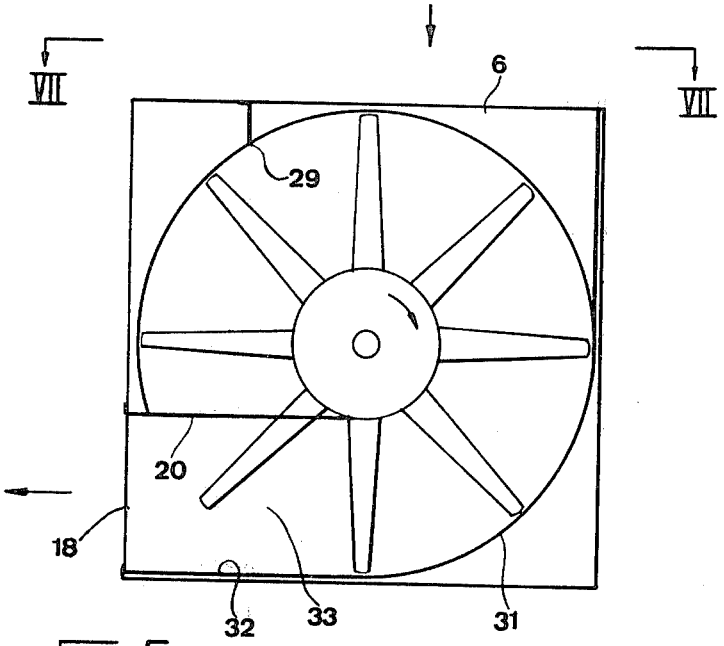
FIG. 6 is a diagrammatical section of the embodiment according to FIG. 5 viewed along line VI—VI in FIG. 7.
Figure 7:
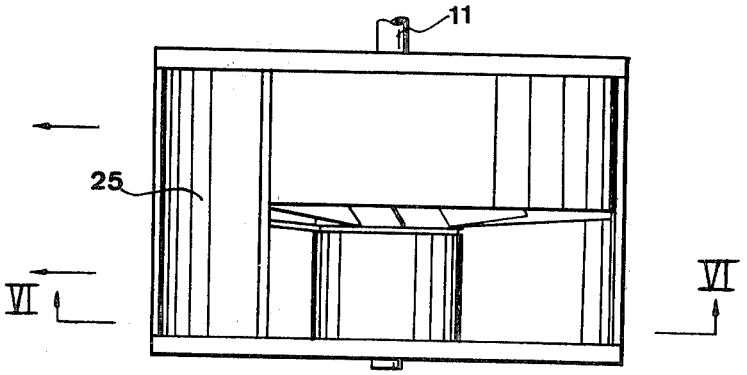
FIG. 7 is a plan view of the embodiment according to FIG. 6 along the line VII—VII.

In FIGS. 5–7, a housing is generally denoted 1 and has a parallelepiped form and comprises two side walls 2, 3 a rear wall 4 and a bottom 5. The other sides, namely the upper side and the lower side, of housing 1 are open. A rotatably journalled fan wheel 7 is provided within housing 1 and has radially extending vanes 8. The wheel 7 has an essentially cylindrical hub 9 comprising a shaft 10, one end 11 (FIG. 7) of which is intended for connection to a motor (not shown) arranged outside housing 1. The shaft 10 extends between side walls 2, 3 and is supported in bearings 12 thereon. The hub 9 comprises a movable hub part 13 and two stationary hub pars 14, 15, which are arranged on opposite sides of hub part 13 and may be rigidly connected to side walls 2, 3.

The housing 1 comprises a circular mantle 16 which is partially surrounding the peripehery of wheel 7. An inlet opening 6 for the fluid to be transported is formed by the open upper side of housing 1 and an opening 17 in the mantle 16. An outlet opening 18 for the fluid to be transported is formed by the open forward side of housing 1 and an opening 19 in mantle 16. A partition 20 extends from at least one side wall towards the wheel 7. More specifically, the partition 20 extends between side walls 2, 3 and between the hub 9 and the mantle 16. The partition 20 is preferably parallel to the shaft 10 of the wheel and has an opening 21 to allow passage of the vanes 8 with a comparatively small clearance. The partition 20 may consist of two parts 22, 23 connected to the stationary hub parts 14, 15 and to a portion of the mantle 16 and/or a support rib 24 provided between sid walls 2, 3.

The partition 20 extends essentially tangentially relative to the hub 9 as is apparent from FIG. 6.

The mantle 16 is formed by three mantle parts, one of which is denoted 25 and extends between side walls 2, 3 and thus covers partially the periphery of wheel 7. The mantle part 25 extends, in the direction of rotation of wheel 7, from partition 20 to the vicinity of the inlet opening 6, where the mantle part 25 merges in an upwardly directed flange 26 forming a limitation of inlet opening 6. A reinforcing rod 27 extends between side walls 2, 3. The other mantle part 28 is connected to the mantle part 25 at 29 (FIG. 6) and to side wall 3, from which the mantle part 28 extends to essentially the center of the periphery of wheel 7. Since the mantle part 28 extends only along essentially half the axial extent of housing 1 the opening 17 in the mantle 16 is formed. A sheet piece 30 is attached to the rear wall 4 and bottom 5 of housing 1 and forms an arcuate transition between said rear wall 4 and bottom 5, said arcuate portion of the sheet piece being essentially concentric to wheel 7 and forming the third mantle part 31. The end of mantle part 28 remote from mantle part 25 may be connected to sheet piece 30 at the beginning of its arcuate portion. The sheet piece 30 extends between side walls 2, 3. The arcuate mantle part 31 merges in a wall part 32 extending essentially parallel to partition 20. The space between wall part 32 and partition 20 constitutes and outlet passage 33 extending essentially tangentially relative to the wheel and terminating in the outlet opening 18.

When the wheel 7 is rotated, the fluid will be sucked into the inlet opening 6 and caused to pass through the wheel in an helicoidal, essentially axial movement and then pass out through outlet opening 18. Since the partition 20 is arranged essentially tangentially relative to the hub of the wheel and together with the wall part 32 forms an outlet passage having an essentially constant sectional area, an advantageous fluid flow will be obtained in that the fluid flow will be essentially constant during the exhaust. As with the embodiments according to FIGS. 1–4, the embodiment according to FIGS. 5–7 makes it possible to obtain a higher pressure downstream the wheel by the arrangement of housing 1. In the embodiments according to FIGS. 5–7 a part of the fluid will pass through the wheel while a part of the fluid will be drawn along by the fan wheel on the suction side thereof, however without passing through the fan wheel. This fact has proven to increase the flow capacity of the fan although the pressure qualities are effected negatively. In case the arrangement according to FIGS. 5–7 is to be used as a turbine, that is the wheel is to be driven by the fluid, or as a pump for heavier fluids, such as liquids, measures should be taken to prevent the fluid from passing through the housing without passing through the wheel; a mantle part 34 illustrated with dashed lines in FIG. 5 may for instance be provided between side wall 2 and the periphery of the wheel and between mantle parts 25 and 31. The partition part 22 may alternatively be extended towards the rear wall 4.

Figure 14:
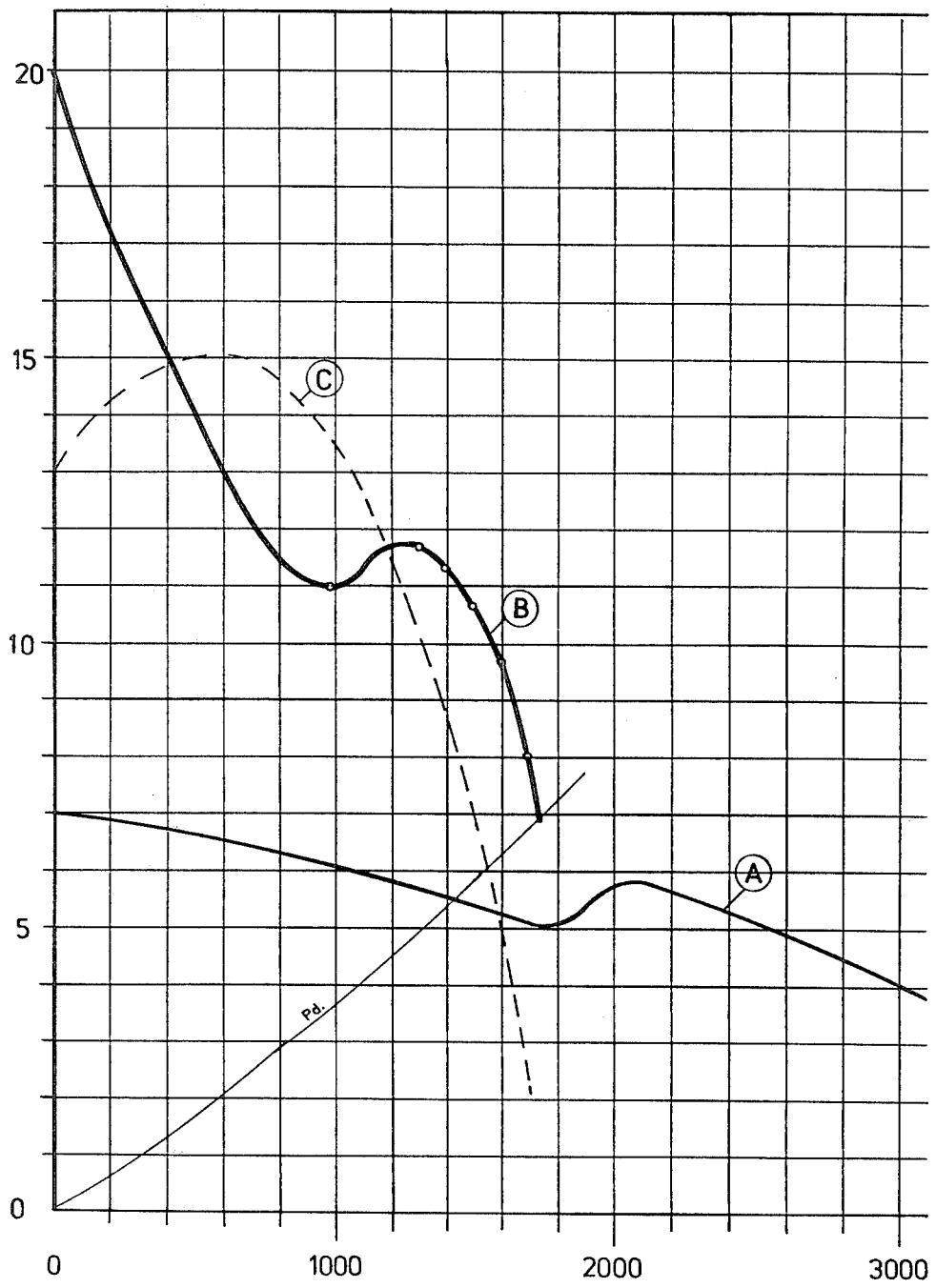
FIG. 14 is a diagram illustrating pressure-flow characteristics for the embodiment according to FIGS. 5–7 as compared to conventional fans.

Reference is now made to FIG. 14 illustrating pressure-flow characteristics for the fan according to FIGS. 5–7 in comparison with conventional fan constructions. Graph A concerns a conventional axial flow fan having a wheel with a diameter of 450 mm driven at a number of revolutions of 900 per minute. Graph B concerns the embodiment according to FIGS. 5–7 having an axial wheel with a diameter of 450 mm driven at a number of revolutions of 900 per minute. Graph C concerns a conventional radial flow fan having rearwardly bent vanes and an inlet opening having a diameter of 400 mm and this fan was also driven at a number of revolutions of 900 per minute. The abscissa indicates the air flow in $m^3/h$ and the ordinata the pressure increase in mm water column.

As appears from FIG. 14, the embodiment according to the invention presents considerably improved pressure qualities over conventional axial flow fans. In certain ranges, the embodiment according to the invention has more advantageous characteristics than the conventional radial flow fan.

Figure 8:
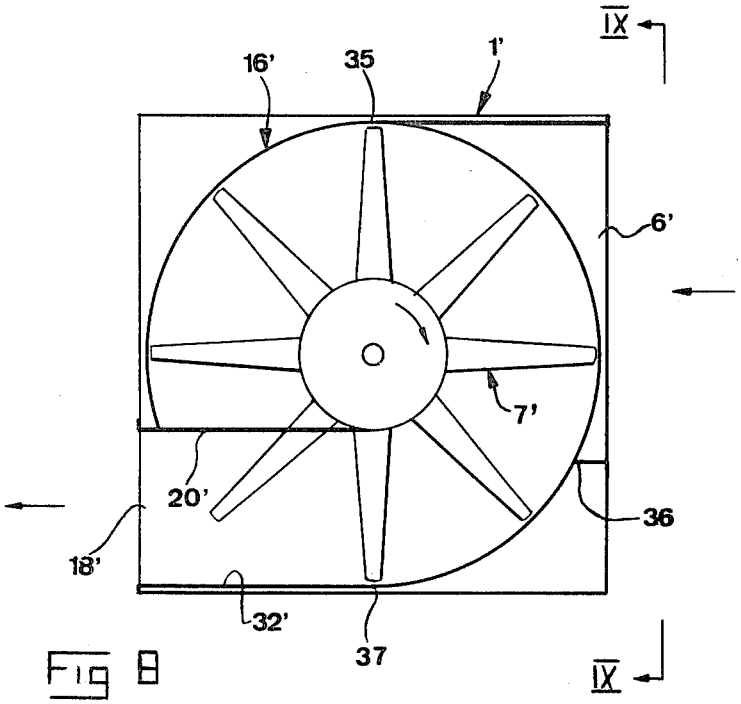
FIG. 8 is a diagrammatical section of another embodiment viewed along the line VIII—VIII in FIG. 9.
Figure 9:
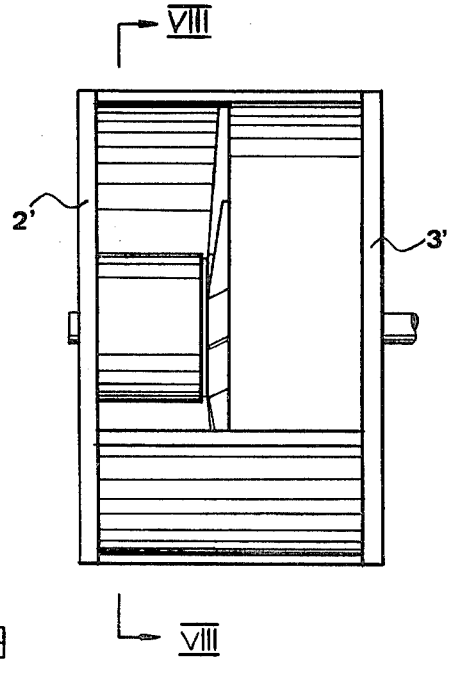
FIG. 9 is a view of the embodiment according to FIG. 8 viewed along the line IX—IX.

In FIGS. 8–9 an alternative embodiment is illustrated. This embodiment differs from the embodiment according to FIGS. 5–7 in that the direction of fluid flow to the wheel 7', as viewed in the axial direction of the wheel, is essentially parallel and uni-directional to the flow away from the wheel. The inlet opening 6' and outlet opening 18' are provided in diametrically opposed sides of housing 1'. Between the partition 20' and point 35, the mantle 16' extends between the side walls 2', 3' of the housing. Between point 35 and point 36, the mantle 16' extends from side wall 3' to the vicinity of the periphery of wheel 7'. Between points 36, 37 the mantle 16' extends from one side wall 2' to the other side wall 3' and merges at point 37 into a wall part 32' arranged in parallel to partition 20'. In other aspects, the embodiment according to FIGS. 8–9 corresponds to the previous embodiment.

In the embodiment according to FIGS. 8–9, the fluid will flow through the housing in a shorter path than in the embodiment according to FIGS. 5–7 and this fact causes a somewhat better flow capacity but a decreased ability to create pressure.

Figure 10:
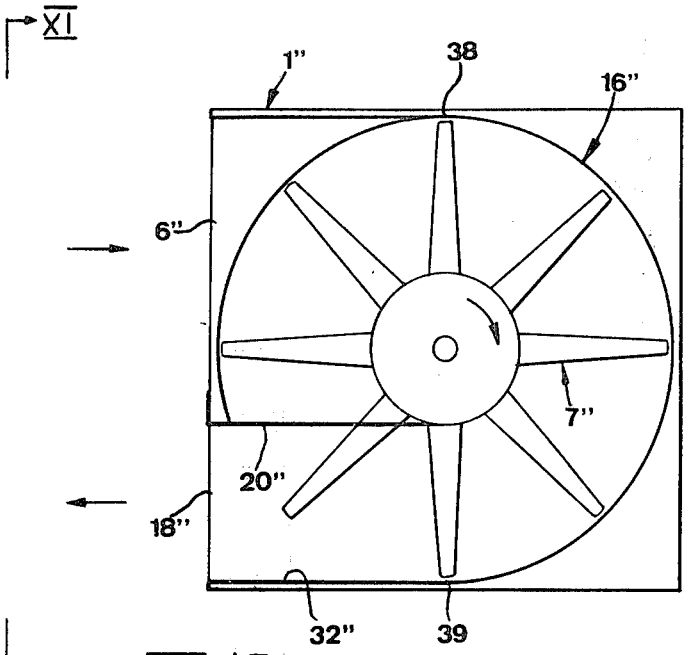
FIG. 10 is a diagrammatical section of another embodiment viewed along the line X—X in FIG. 11.
Figure 11:
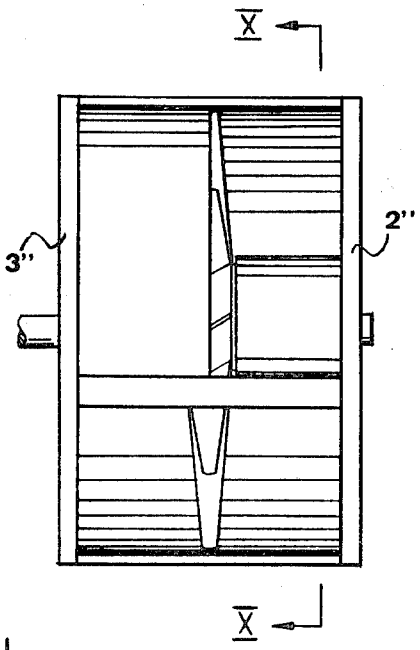
FIG. 11 is a view of the embodiment according to FIG. 10 along the line XI—XI.

In FIGS. 10–11 an additional embodiment is illustrated. The embodiment according to FIGS. 10, 11 differs from the embodiments according to FIGS. 5–9 in that the direction of fluid flow to wheel 7'', as viewed in the axial direction of the wheel, is essentially oppositely directed relative to fluid flow away from the wheel. The inlet opening 6'' and outlet opening 18'' of the housing are provided in the same side wall. Between partition 20'' and point 38, the mantle 16'' extends from side wall 3'' to the vicinity of wheel 7''. From point 38 to point 39, the mantle 16'' extends between side walls 2'',3'' and at point 39 the mantle merges in a wall part 32'' parallel to partition 20''. Thus, the fluid will pass through the arrangement in a longer path as compared to the embodiments according to FIGS. 5–9 and therefore a somewhat better pressure capacity is obtained but a somewhat lesser flow capacity.

Figure 12:
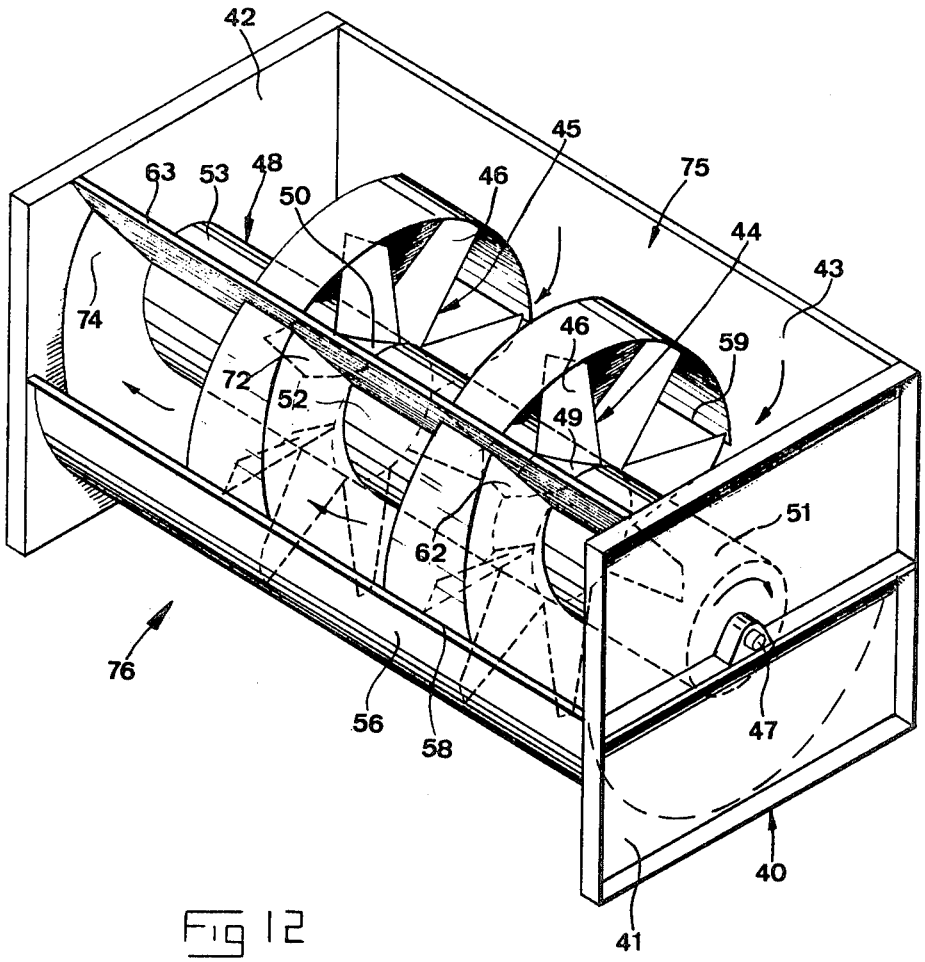
FIGS. 12 and 13 are partially cut, perspective views of an additional embodiment.
Figure 13:
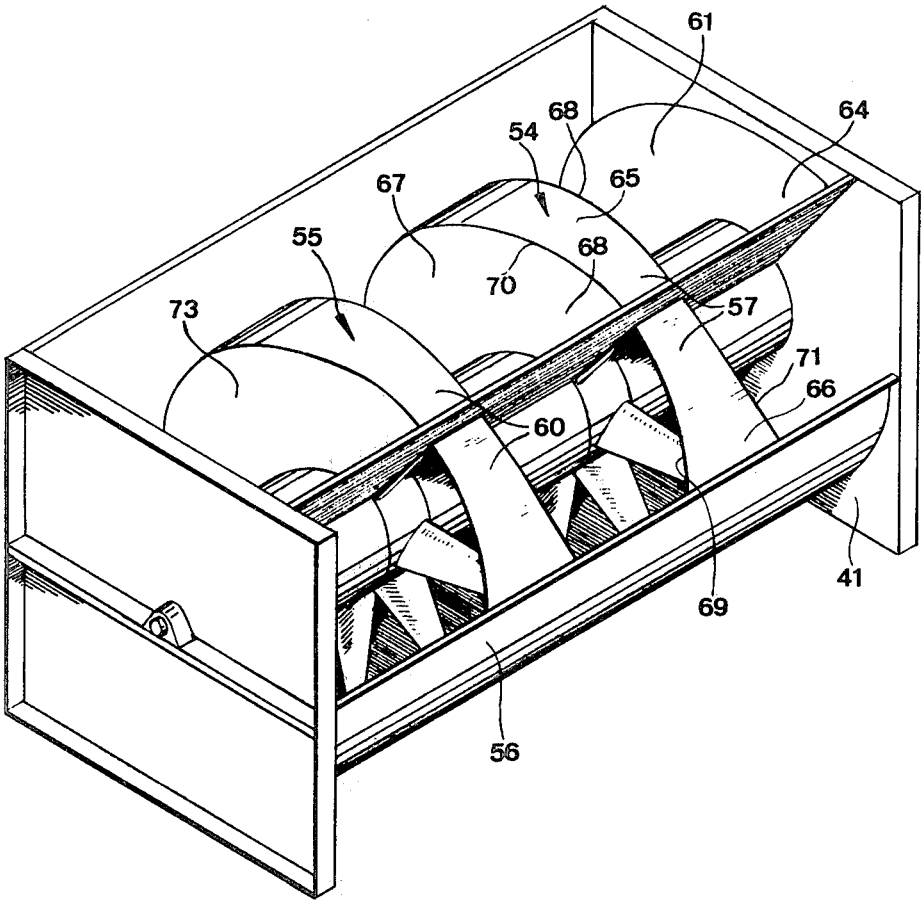

In FIGS. 12–13 another embodiment of the invention is illustrated. A casing generally denoted 40 comprises two suitably parallel end walls 41, 42 and a rear wall 43 extending between the end walls. Between end walls 41, 42 two fan wheels 44, 45 having vanes 46 are rotatably journalled. The wheels have a common axis of rotation 47 extending between side walls 41, 42 and being journalled therein. The wheels 44, 45 have a hub 48 comprising two movable hub parts 49, 50 and three stationary hub parts 51–53. The hub 48 is essentially cylindrical.

Each of the wheels 44, 45 is arranged in a housing formed by a mantle provided about the periphery of the wheel and two side walls which are provided on opposite side of the wheel and extend transversely of the axis of rotation. The mantle for wheel 44 is denoted 54 while the mantle for wheel 45 is denoted 55. Between end walls 41, 42 there is provided a mantle part 56 having an arcuate form and being concentric to axis of rotation 47. The sectional shape of mantle part 56 is indicated in FIG. 12 with dashed lines. The mantle part 56 merges into or is connected to rear wall 43 which is a tangential extension of mantle part 56 which is closely conforming to the periphery of the wheel. Portions of mantle part 56 are used to form the mantles 54, 55. The mantle 54 is additionally constituted by a second arcuate mantle part 57 which is connected to the first mantle part at 58 and 59 and forms an essentially cylindrical configuration therewith. The mantle 55 has a second mantle part 60 analogous to mantle part 57. Mantle parts 57 and 60 cover the peripheries of the wheels.

A side wall 61 for wheel 44 runs helicoidally about the stationary hub part 51 towards the wheel 44. The edge of side wall 61 adjacent to hub part 51 may be attached thereto and the periphery of side wall 61 may partially be attached to the inside of mantle part 56. The side wall end 62 adjacent to wheel 44 is located comparatively close to the side of wheel 44, i.e. the vanes of the wheel pass near side wall end 62. The side wall end 62 may also be connected to a dividing wall 63 extending between end walls 41, 42 and radially outwardly from hub 48 to delimit an inlet opening to casing 40 from an outlet opening. The dividing wall 63 has recesses for the vanes 46.

The side wall 61 runs essentially 360° about hub part 51 and the end 64 facing away from the wheel 44 is connected to dividing wall 63. The mantle part 57 is divided into two parts 65, 66 extending on opposite sides of dividing wall 63. The part 66 extends from the periphery of side wall 61 to the vicinity of or somewhat past the periphery of the wheel 44. On the opposite side of wheel 44 is provided a second side wall 67 which is helicoidally wound about hub part 52 and which is connected to the dividing wall part facing towards the inlet side of casing 40 with its end 68 located adjacent wheel 44. The side wall 67 is connected with its periphery to mantle part portion 65 which extends to the vicinity of or past the periphery of the wheel. Thus, the portions 65, 66 of mantle part 57 has an axially facing edge 68 and 69 respectively extending essentially perpendicularly to the axis of rotation 47 and a second axially facing edge 70 and 71 respectively which is adapted to the helical shape of side walls 61, 67.

Also side wall 67 runs essentially 360° about hub part 52 and is with its other end 72 located adjacent the side of wheel 45 and connected to dividing wall 63. The side wall 67 is with its periphery partially attached to mantle part 56 and to mantle part 60 of wheel 45, said latter mantle part being analogous to mantle part 57. Hence, the sidewall 67 forms a side wall for wheel 44 as well as wheel 45. A third side wall 73 is located on the side of the wheel 45 opposite to side wall 67 and connected to the dividing wall 63 and mantle part 60. Also side wall 73 runs helicoidally about hub part 53 in essentially 360°. The end 74 of side wall 73 is connected to dividing wall 63 and endwall 42.

Thus, the side walls 61 and 67 on one hand and side walls 67 and 73 on the other are located closely to wheels 44 and 45 respectively in the vicinity of dividing wall 63 but said side walls leave the wheels in a direction away from the dividing wall 63.

The inlet opening 75 to the wheels 44, 45 is constituted by the open upper side of casing 40 and the openings formed by the fact that the side walls 61, 67 extend away from the wheels. Similarly, the outlet opening 76 of casing 40 is constituted by the open forward wall of casing 40 and the fact that the side walls 67, 73 extend helicoidally away from wheels 44, 45, the dividing wall forming a limitation between the inlet side and outlet side of casing 40.

When wheels 44, 45 are rotated in the direction of rotation indicated, the fluid will be sucked to the wheels and pass through the same into the spaces on the pressure side of the wheels and then the fluid is transported in a helicoidal path out of the fan casing. By means of the helical side walls a preferable flow function is obtained and by the location of the side walls adjacent to the wheels in the vicinity of the dividing wall 63 it is possible to obtain excellent pressure capacity. The reader will observe that the entire amount of fluid must pass through the wheels 44, 45 in this embodiment which is especially preferable for use as a turbine, i.e. when the wheels 44, 45 are driven by a fluid passing through.

The invention is obviously not restricted to the embodiments described. The arrangement according to the invention may be modified in several ways for instance regarding the location and size of the inlet and outlet openings, the shape of the partition, the distance between the side walls and the wheel and the shape thereof. Modifications may be motivated by required relations between pressure and flow and the aim of obtaining a maximum efficiency. The above description is also valid for compressors, turbines and pumps and their combinations, especially compressors and turbines. The embodiment according to FIGS. 12 and 13 may of course have any desired number of wheels arranged on a common shaft. It should be understood that only one wheel between two helicoidal side walls may be used. In the embodiments according to FIGS. 1–11, the side walls may consist of planar sheet pieces inclined relative to the axis of rotation of the wheel and located near the side of the wheel at portions lying close to each other so as to obtain a division of the space between the sheet pieces into an inlet and outlet side. The vanes may be modified in several ways and for instance comparatively long vanes may be used in order to obtain a longer flow path through the wheels and housings.

What I claim is:

1. An arrangement in fans, compressors, turbines, pumps and the like, said arrangement comprising at least one wheel having vanes of the axial flow type, said wheel being arranged in a housing having at least one inlet and one outlet opening and formed by a mantle provided at least partially about and closely adjacent to the periphery of the wheel and at least two side walls provided on opposite sides of the wheel, least the side wall located on the downstream side of the wheel being at least partially spaced from the adjacent axial sides of the vanes of the wheel, said housing having at a circumferential location thereof a restriction forming a narrowed passage for the vanes of the wheel, said narrowed passage having a shape closely conforming to the shape of the vanes so as to form a fluid barrier within the housing minimizing fluid flow through the passage while allowing close passage of the vanes of the wheel.

2. Arrangement according to claim 1, wherein said side walls extend towards the wheel in helicoidal form, the portions of the side walls located adjacent the wheel being essentially opposite each other as viewed in the axial direction of the wheel and forming said narrowed passage, said helicoidal side walls having a radial extent generally equal to the radial length of the vanes.

3. Arrangement according to claim 2, wherein at least two wheels are provided on a common shaft and the side walls between two adjacent wheels are formed by a single helicoidal wallpiece extending from a position adjacent one wheel to a position adjacent the other.

4. Arrangement according to claim 2, wherein the inlet and outlet openings are provided in the mantle and a dividing wall extends essentially parallel to the axis of rotation of the wheel and in a direction away from the wheel from said portions of the side walls located adjacent the wheel.

5. Arrangement according to claim 4, wherein the helicoidal side walls extend essentially 360° about the axis of rotation of the wheel, the ends of the side walls remote from the wheel being located at said dividing wall.

6. An arrangement for use in fans, compressors, turbines, pumps and the like, said arrangement comprising at least one wheel having vanes of the axial flow type, said wheel being arranged in a housing having at least one inlet and one outlet opening and formed by a mantle provided at least partially about and closely adjacent to the periphery of the wheel and at least two side walls provided on opposite sides of the wheel and being spaced from the vanes of the wheel, and a partition extending between the side walls and presenting an opening for the vanes of the wheel, the shape of said opening closely conforming to the shape of the vanes.

7. Arrangement according to claim 6, wherein said wheel has a hub and said partition extends between said hub and said mantle.

8. Arrangement according to claim 6, wherein the inlet and outlet openings are provided in the side walls and said openings are angularly displaced relative to each other.

9. Arrangement according to claim 6, wherein the inlet and outlet openings are provided in the mantle and said openings are angularly displaced in relation to each other.

10. Arrangement according to claim 6, wherein at least one of the inlet and outlet openings is provided in one of the side walls and the other of said openings is provided in the mantle, said openings being angularly displaced.

11. Arrangement according to claim 6, wherein the partition is provided between the inlet and outlet openings as viewed in the axial direction of the wheel.

12. Arrangement according to claim 6, wherein the inlet opening is provided in the housing on the upstream side of the wheel and the outlet opening, which is provided in the mantle, communicates with the downstream side of the wheel as well as the upstream side of the wheel within the housing.

13. Arrangement according to claim 6, wherein said wheel has a relatively wide hub and the partition extends tangentially relative to said hub for the wheel.

* * * * *